United States Patent [19]

Small

[11] Patent Number: 4,711,454

[45] Date of Patent: Dec. 8, 1987

[54] BINGO GAME INVOLVING PROMOTIONAL COUPONS

[76] Inventor: Maynard E. Small, 105 Ward Pkwy., Apt. 507, Kansas City, Mo. 64112

[21] Appl. No.: 923,346

[22] Filed: Oct. 27, 1986

Related U.S. Application Data

[63] Continuation of Ser. No. 699,311, Feb. 7, 1985, Pat. No. 4,619,457, which is a continuation-in-part of Ser. No. 385,840, Jun. 7, 1982, Pat. No. 4,509,759, which is a continuation-in-part of Ser. No. 273,259, Jun. 12, 1981, Pat. No. 4,342,457, which is a continuation of Ser. No. 79,189, Sep. 26, 1979, Pat. No. 4,285,520.

[51] Int. Cl.[4] ..... A63F 3/06
[52] U.S. Cl. ..... 273/269
[58] Field of Search ..... 273/240, 269, 286, 287

[56] References Cited

U.S. PATENT DOCUMENTS

| | | | |
|---|---|---|---|
| 2,124,136 | 7/1938 | Bugg | 273/260 X |
| 2,484,143 | 10/1949 | Arnold | 273/269 |
| 3,534,963 | 10/1970 | Weimer | 273/269 |
| 3,603,592 | 9/1971 | Bury | 273/269 X |
| 3,941,388 | 3/1976 | Isaac et al. | 273/287 X |
| 3,998,465 | 12/1976 | Mascola | 273/269 X |

FOREIGN PATENT DOCUMENTS

| | | | |
|---|---|---|---|
| 872703 | 7/1961 | United Kingdom | 273/269 |

OTHER PUBLICATIONS

Playing Card entitled"Play Loblaw's Check-Out Game; earliest U.S. copyright 1937.
"Product Picture Game", Detroit Times Newspaper, Jun. 9, 1955, p. 40.
Flyer entitled "National Product Check-Out Game", copyright 1966.
Playthings, Sep. 1978, pp. 128-132 and 135.
"Saturday Evening Post Bingo", Saturday Evening Post, May/Jun., 1981, pp. 8 and 9.

*Primary Examiner*—Anton O. Oechsle
*Attorney, Agent, or Firm*—Litman, McMahon & Brown

[57] ABSTRACT

A game for a plurality of players wherein each player is provided with a playing card, said playing card being presented to the players by means of a mass distribution publication. The playing card comprises a matrix of delineated areas, such as squares, in rows and columns, each square bearing a certain indicia which is to be matched with a corresponding indicia found in a plurality of promotional coupons present in the same publication or in a publication provided with the playing card. The player matches such indicia and continues to do so until he has satisfied any one of several particular combinations of matched indicia. The player also may be any one of several required to ascertain the correct total number of coupons having appropriate indicia that appear in the publication in order to win the game or become eligible to progress toward winning a prize.

16 Claims, 14 Drawing Figures

BINGO GAME INVOLVING PROMOTIONAL COUPONS

CROSS-REFERENCE TO RELATED APPLICATIONS

The present application is a continuation of U.S. patent application Ser. No. 699,311 filed Feb. 7, 1985, entitled BINGO GAME INVOLVING PROMOTIONAL COUPONS, now U.S. Pat. No. 4,619,457, which was a continuation-in-part of U.S. patent application Ser. No. 385,840 filed June 7, 1982, entitled BINGO GAME INVOLVING PROMOTIONAL COUPONS, now U.S. Pat. No. 4,509,759, which was a continuation-in-part of U.S. patent application Ser. No. 273,259 filed June 12, 1981, entitled METHOD OF PLAYING A MASS CIRCULATION PUBLICATION BINGO TYPE GAME, now U.S. Pat. No. 4,342,457, which was a continuation of U.S. patent application Ser. No. 79,189 filed Sept. 26, 1979, entitled MASS CIRCULATION PUBLICATION BINGO TYPE GAME, now U.S. Pat. No. 4,285,520.

SUMMARY OF THE INVENTION

This invention relates to game apparatus and, more particularly to game devices which require the use of a game board or card in matching certain given indicia with corresponding indicia found or supplied separately from the game board or provided contemporaneously therewith.

The game apparatus contemplated by this invention comprises a game board or card which is supplied to the players through a mass distribution, multi-page publication, such as a newspaper or magazine. In one form, the board or card is printed "ROP" (run of press), rather than constituting a separate insert placed between the pages of the publication. However, in other forms, the insert type of playing card, or other card delivery system might be used, if desired. One such system would be to provide such a playing card in a free-standing insert, that is, a supplemental advertising insert to a multi-page, run of press newspaper, although the free-standing insert may be provided as a separate self-contained unit. Each playing card for a particular game can be identical, or certain of the playing cards may be dissimilar depending on the manner in which the game is to be played.

The card is divided into a matrix of delineated areas, such as squares, with each square having a certain indicia therein corresponding to indicia found in the same publication. As presently intended, the latter indicia will be in, or associated with, a plurality of devices, such as promotional coupons, for example, the well known tear out or cut out "cents-off" coupons used to encourage the retail sales of consumer items, typically including packaged food, cosmetics and household maintenance aids. For example, the indicia may be the "cents-off" amount, a pictorial depiction of a product, the name of a product manufacturer, or a Universal Product Code (UPC) symbol for a product. In one embodiment comprising run of press publications, such as newspaper and magazines, it is contemplated that the coupon-associated indicia which corresponds to the card indicia will be found in several separated locations within the publication, thus requiring the player to search out and examine a substantial number of coupons throughout the publication, thereby increasing the player's awareness of the existence and availability of many coupons which otherwise may be overlooked. In an embodiment comprising a free-standing insert, the coupon-associated indicia will be included in the free-standing insert.

The player matches the indicia in selected areas or squares on the game card with the appropriate corresponding coupon indicia and continues to match and indicate same on the game card until a particular combination of matched indicia on the card has been obtained, producing a win. The combination of displayed indicia on the game card is carefully precoordinated with the coupon indicia throughout the publication so that the level of difficulty and challenge desired is presented to the player. Further, in one form of the embodiment comprising a free-standing insert, the game cards provided to the players are different such that only a portion of the game cards provided have an orientation or pattern which can possibly produce a winning combination of matched indicia, thereby reducing the number of winners. In another form of the free-standing insert game, all game cards will provide a predetermined first pattern of matched indicia and only a portion of the playing cards will provide a predetermined second pattern of matched indicia with those players making the second predetermined pattern being instant winners. In this manner there may be, for example, many winners of minor prizes and one, or just a few, winners of major prizes for completing the matching process.

An alternative or additional embodiment would also require that the player determine the total number of coupons appearing in the publication and correctly identify this number on the playing card to produce a win. In one preferred form, the completed playing card is returned to the publisher, or its agent, where the card is validated as a win so as to make the player eligible for a prize or other desirable reward, such as entry to a random drawing for a prize. In the alternative, the validation may take place after the drawing to determine specific player eligibility for receiving the prize or reward.

OBJECTS OF THE INVENTION

The principal objects of the present invention are: to provide novel game apparatus utilizing indicial coordination between promotional coupons and game boards in mass distribution publications; to provide such game apparatus involving a cooperative relationship between indicia associated with multiple coupons spread throughout a publication and a game board forming a part of that same publication; to provide a bingo type card game device which utilizes, as playing pieces, promotional coupons in a publication; to provide such a game structure capable of run-of-press ("ROP") presentation to members of the playing public; to provide such a game apparatus wherein the coupon indicia and game card are included in a free-standing advertising insert to a run-of-press newspaper; to provide a mass distribution, multi-page publication comprising a self contained combination of cooperating bingo type board and game-playing indicia members; and to provide such a game structure which is appropriate for inexpensive mass distribution, versatile and well adapted for the proposed use thereof.

Other objects and advantages of this invention will become apparent from the following description taken in connection with the accompanying drawings, wherein are set forth, by way of illustration and example, certain embodiments of this invention.

The drawings constitute a part of this specification and include exemplary embodiments of the present invention and illustrate various objects and features thereof.

DETAILED DESCRIPTION OF THE PREFERRED EMBODIMENTS

Figure 1:
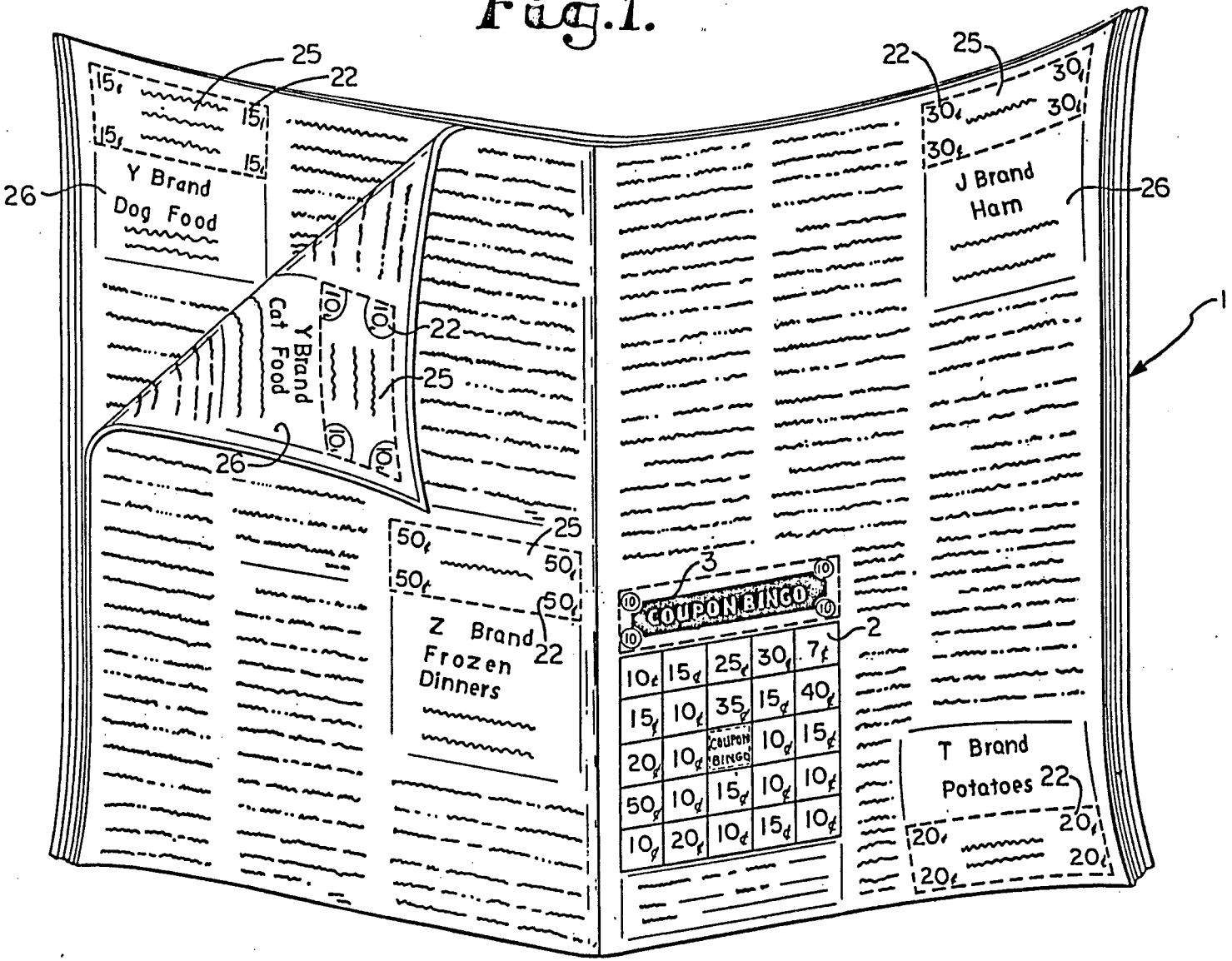
FIG. 1 is a perspective view showing a typical mass distribution newspaper having therein a playing card and associated playing pieces in the form of "cents-off" coupons, according to one form of the present invention.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail:

The reference numeral 1 generally designates a mass publication, in this example a typical daily newspaper, however any suitable printed and widely distributed document of the type which carries advertising would be appropriate. Illustrated in the publication 1 is a game board or playing card 2 which is printed "ROP": or "Run of Press", meaning, in this embodiment, no special arrangements are made for inclusion, such as would be the case if a separate insert were used. Thus, the distribution of the board or card can be as inexpensive as other common printed matter carried by the publication. The particular position of the card 2 within the publication is not of great importance, so long as it is sufficiently prominent to arrest the attention of a potential player of the game.

The card 2, in this example, comprises an identifying heading 3, such as "COUPON BINGO" and a body or matrix 4 which here is divided into vertical columns 5, 6, 7, 8 and 9 and horizontal rows 13, 14, 15, 16 and 17, the rows and columns defining a grid of areas or, in this case, squares 10. Typically contained in pre-selected squares 10 is a certain card or area indicia 21 that is matched with respective corresponding, pre-selected indicia found elsewhere in the publication, the relationship between the card or area indicia 21 and the location and distribution of the other indicia, such as coupon indicia, and specifically coupon value indicia 22, in the publication providing a novel arrangement in game structure.

The area indicia 21 in this example correspond to one or more "cents-off" values forming the coupon value indicia 22, the latter being placed on or in close association with promotional coupons 25, known as "cents-off coupons" which, typically are redeemable by a consumer for a portion of the selling price of a product or products identified thereon and, commonly, in advertising text 26 adjacent thereto. The several coupons 25, respectively bearing various individual value indicia 22, are preferably distributed throughout the publication 1 in substantially greater number than the number of area indicia 21 values and, taken together, certain coupon value indicia 22 may be different from the various area indicia 21 in frequency and amount. The area indicia 21, located in the squares 19, are related to the value indicia 22 so that at least one column 5–9, one row 13–17 or one diagonally aligned group of squares extending from corner to corner of the matrix 4, correspond to a group of values contained in the total values making up the value indicia 22.

Thus, within the publication 1, cooperative means are provided in the form of the printed card 2 and the coupons 25, the latter being distributed in many locations throughout the publication and bearing various value indicia 22, and the former bearing a special and unique relationship to the coupon indicia whereby correspondence exists, but is not obvious, thereby providing the challenge necessary to create gaming interest in a player.

As seen in FIG. 1, the coupons 25 are randomly spaced throughout the publication so as to be spaced apart therein. Further, at least a portion of the coupons 25 are positioned at various isolated locations throughout the pages of the publication so as to be spaced apart from one another by printed subject matter unrelated thereto and at least a portion of the coupons 25 are located on pages separate from the playing card 2.

In playing the game, a player preferably cuts out all of the coupons in the publication; however, another form of tabulation of the value indicia 22 may be used. The player then compares the various value indicia 22 to the respective area indicia 21 values on the card 2, also found in the publication 1. When a match is found between a value indicia 22 and an area indicia 21, that one area indicia 21 value is noted on the card 2, as by circling the figure or figures in the appropriate square 19. By repeating this procedure, the player should eventually discover the predetermined correspondence between selected value indicia 22 and area indicia 21, which produces a win, that is, a completed row, column or diagonal group as noted above.

For variation, if desired, the center area or square 19 in the matrix 4 (or one or more other squares, not shown) may be designated "free", as is done in certain "bingo"-type games. Such a "free" square is designated by the reference numeral 28 in FIG. 2 and constitutes a square which need not be matched to a value indicia 22 for completing the center row 15, the center column 7 or the diagonally aligned groups.

Also, an added challenge may be provided in requiring that the player furnish, on the card 2, the correct total number of coupons appearing in the publication 1 and from which the win has been obtained.

Figure 2:
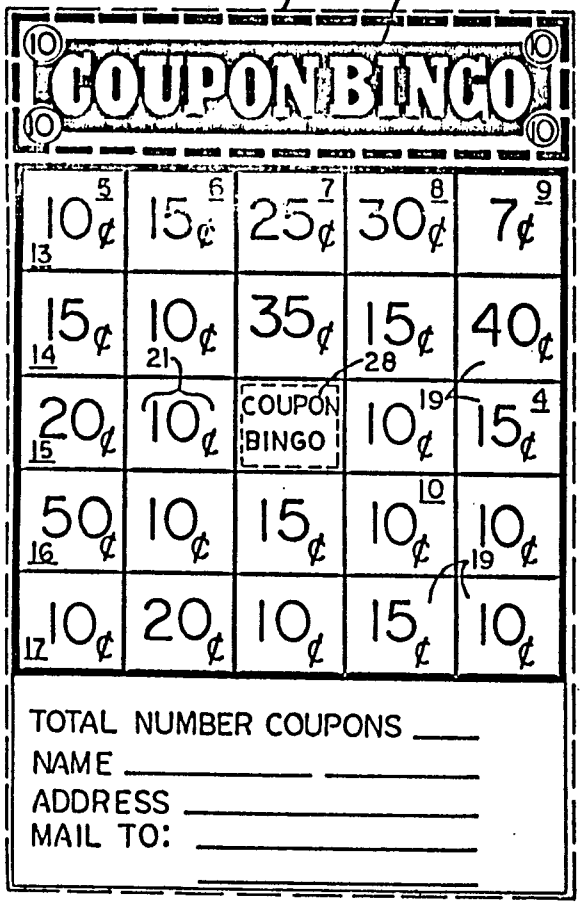
FIG. 2 is a detailed plan view of the playing card of FIG. 1.
Figure 3:
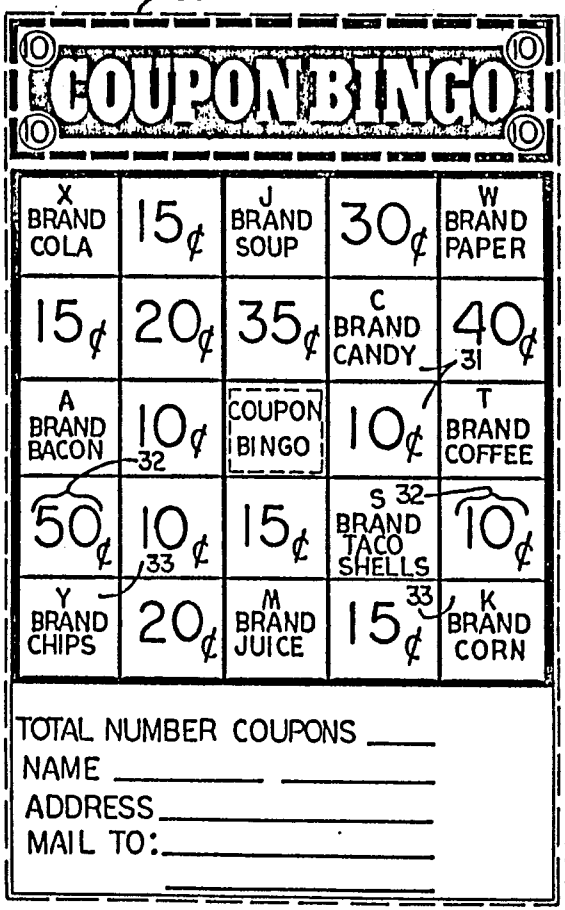
FIG. 3 is a plan view similar to FIG. 2 illustrating a second embodiment of this invention wherein the playing card indicia includes a mixture of product identities and "cents-off" values in coupons found in the publication.

FIG. 3 illustrates another embodiment of this invention wherein certain of the value indicia 21 of FIG. 2 are replaced by product identifications on the card 2. Thus, the indicia 31 on the card 30 is a mixture of numerical values 32 and product identifications 33. The game is played in the same manner as described above, however, the player need only locate a coupon referring to the corresponding product in a product square, rather than a numerical value on a coupon.

Figure 4:
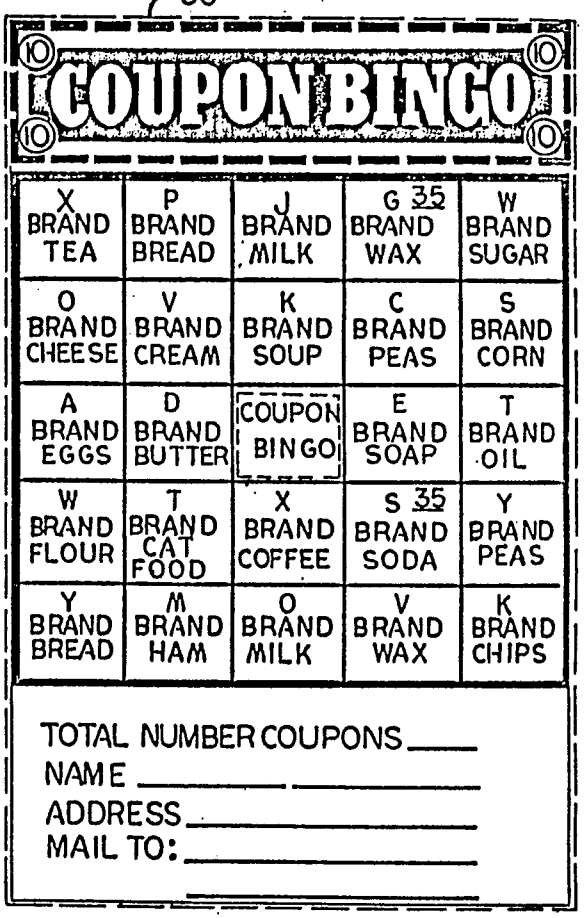
FIG. 4 is a plan view similar to FIG. 2 illustrating a third embodiment of this invention wherein the playing card indicia entirely consists of product identities associated with coupons found in the publication.

FIG. 4 illustrates a further embodiment which carries the structure of FIG. 3 another step, that is, where all the active (not "free") areas or squares 35 on the card 36 constitute product identities rather than numerical values.

The player may be instructed to send the played card to an appropriate reception center where, if the win is validated, the player receives a prize or becomes eligible to win a prize.

Although the particular examples described above contemplate rows, columns or aligned groups to produce a win, additional combinations may also be used, such as matching the four corner squares, or other patterns. It is only necessary that the player be informed, prior to beginning play, what arrangement or arrangements are required, the data (coupons) being previously arranged to produce a win with the desired degree of difficulty.

Also it should be realized that variation could utilize manufacturer's names instead of product identities and adaptations could be made for other printed devices indicia such as "buy one, get one free" coupons.

Figure 5:
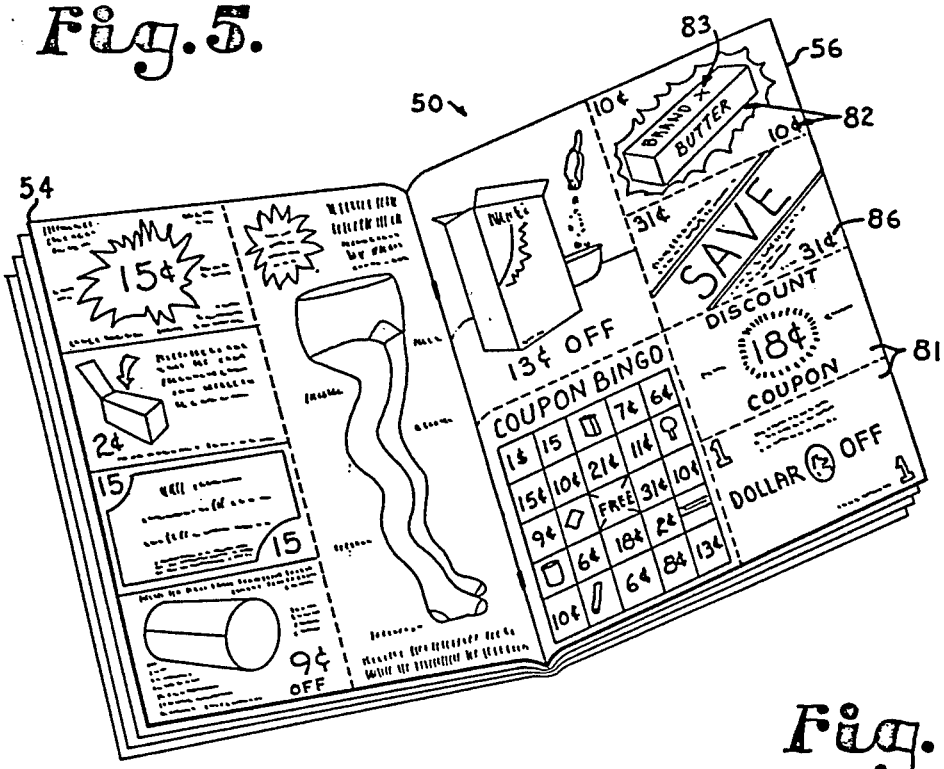
FIG. 5 is a perspective view showing a fourth embodiment of the present invention wherein the playing card is part of a multi-page free-standing insert with the free-standing insert comprising an advertising insert including product coupons having cents-off value indicia thereon which are matchable with the playing card indicia along with product identity indicia.
Figure 6:
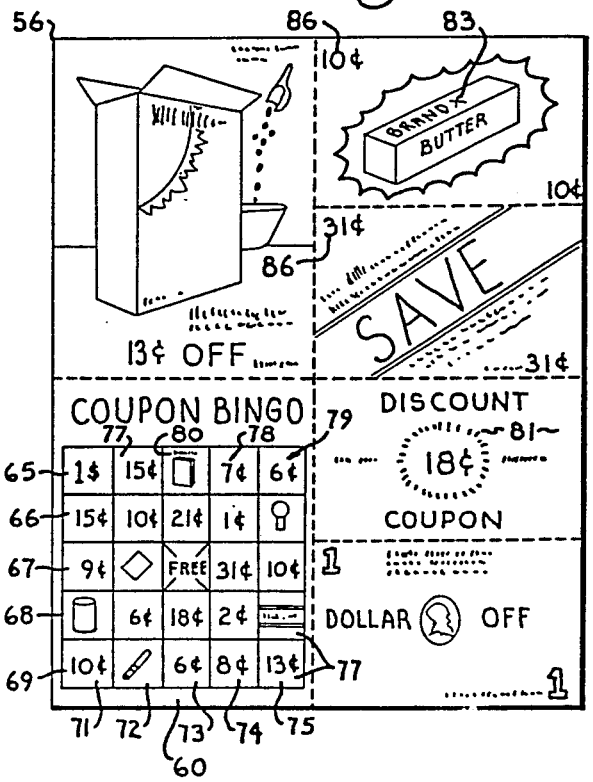
FIG. 6 is a front plan view of a single page of a free-standing insert shown in FIG. 5 showing the playing card and various product coupons.
Figure 7:
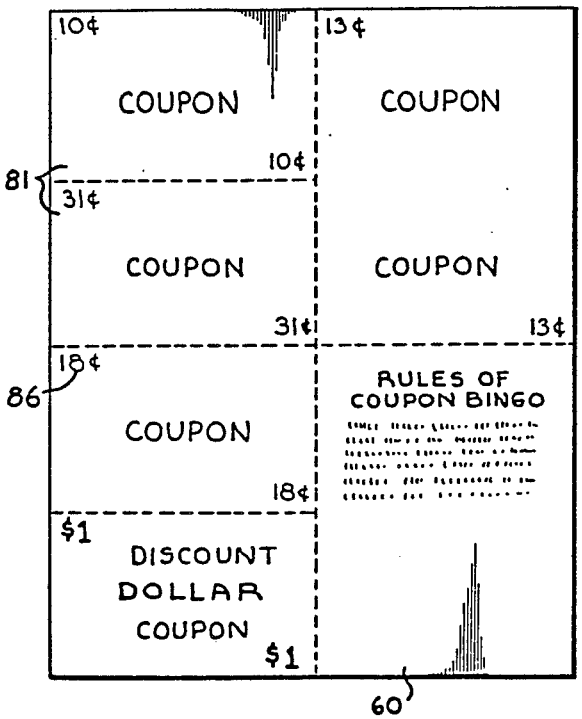
FIG. 7 is a rear plan view of the free-standing insert page shown in FIG. 6.
Figure 8:
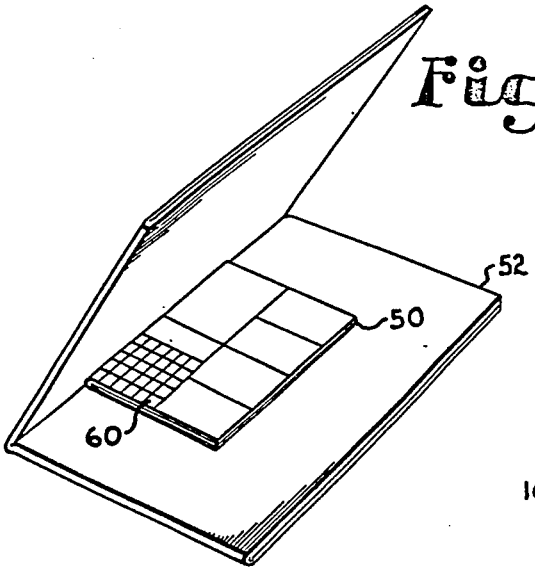
FIG. 8 is a perspective view showing a free-standing insert as it is inserted into a run of press newspaper.
Figure 9:
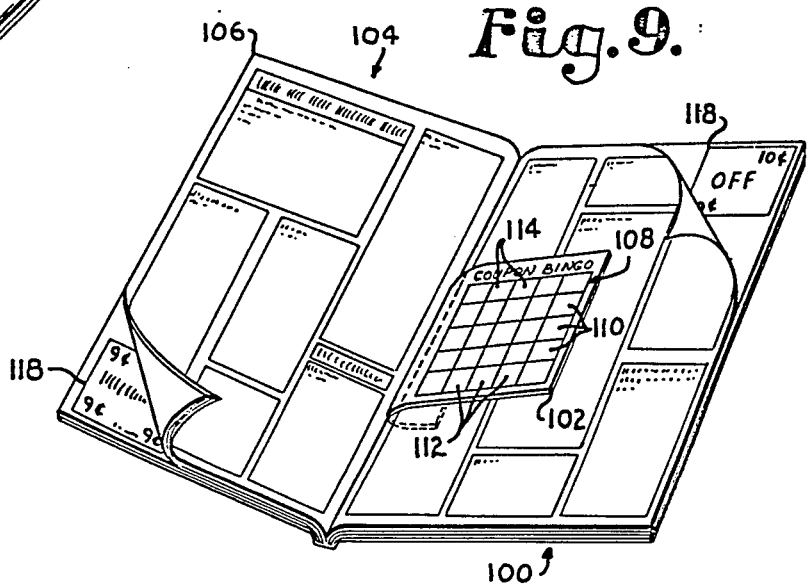
FIG. 9 is a perspective view of a fifth embodiment of the present invention showing a playing card inserted into a run of press magazine with the magazine having coupon indicia matchable with the playing card indicia spaced through the magazine.

FIG. 5 shows a fourth embodiment of the present invention and comprises a free-standing insert 50 which is adapted to be inserted into a suitable mass circulation, run-of-press publication such as the newspaper 52 shown in FIG. 8. The free standing insert comprises a plurality of pages 54. Printed on one of the pages 56 is a playing card 60. The playing card 60 includes a series of rows 65, 66, 67, 68 and 69 and a series of columns 71, 72, 73, 74 and 75. The rows and columns define the grid of areas comprising squares 77. Each of the squares 77 includes therein a suitable indicia 79 such as a cents-off value 78 or a product name 80.

The remainder of page 56 and the other pages of the free-standing insert 50 includes a plurality of advertising coupons 81 which include thereon coupon indicia 82 comprising a product name indicia 83 and a cents-off indicia 86. A player of the game will match a suitable coupon indicia 82 with the playing card indicia 79. As before, a predetermined orientation or pattern of matched indicia will produce a win.

By using a free-standing insert 50 as shown herein, a suitable promoting entity such as a retailer, manufacturer or printer, can provide a game apparatus which will encourage players thereof to thoroughly review all of the coupons 81 in the free-standing insert 50 to produce a desired matched indicia orientation or pattern required for a win. In providing the playing card 60 and the coupons 81 in the free-standing insert, the entity who promotes the playing of the game will be assured that the players of the game will be encouraged to read only coupons desired by the game promoting entity and not other promotional coupons which might be dispersed throughout the newspaper 52.

It is anticipated that the set of free-standing inserts 50 provided for a single edition of a newspaper 52, or a magazine or the like, can comprise two portions or groups, with the orientations or patterns of indicia 79 in the playing card provided for each portion or group of the set being dissimilar, that is, at least two cards have different patterns of indicia thereon. In doing so, there can be provided two different orientations or patterns of matched indicia which will produce a win. The players using a playing card of the first group of the free-standing insert set will have to satisfy a first predetermined orientation or pattern of matched indicia to produce a win whereas the players using playing cards of the second group of the free-standing inserts will have to produce a second predetermined orientation or pattern of matched indicia to produce a win.

Thus, different individual newspapers 52 of a single edition can be provided with playing cards having different orientations or patterns of indicia.

When the set of free-standing inserts comprises the two different portions or groups of inserts, the suitable promoting entity can exercise more control over the game. For example, if a particular prize is associated with a particular predetermined orientation or pattern of matched indicia, the first group of inserts can be printed with playing cards having that particular pattern. The second group of inserts can be printed with cards having a different pattern. Thus, the relative numbers of first and second insert groups can be controlled. If the particular prize associated with the first group of inserts is relatively valuable, the number of such first group of inserts can be limited, thereby also limiting and controlling the number of that particular prize which will be awarded. This is especially important if the particular prize is what is commonly known as the "grand prize", which may be worth $10,000, $100,000 or even more.

Figure 10:
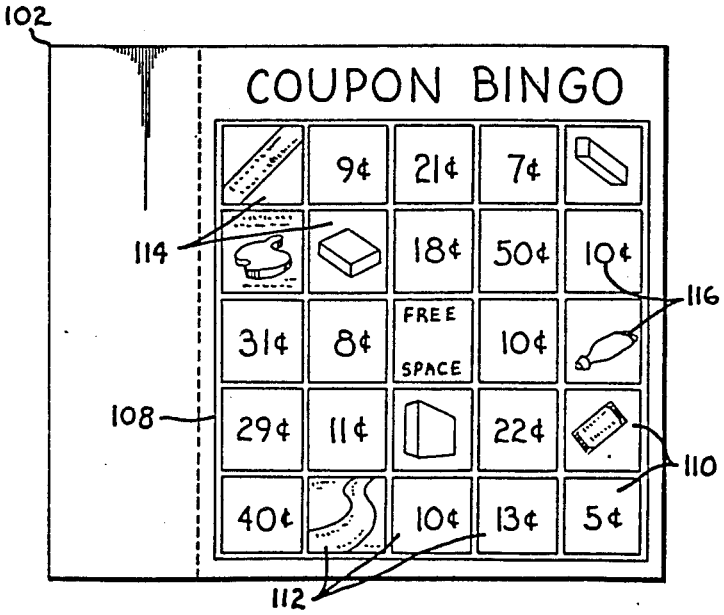
FIG. 10 is a front plan view of the playing card shown in FIG. 9.

The reference numeral 100 generally designates a fifth embodiment of the present game apparatus comprising a playing card 102 and a mass distribution "ROP" publication 104 shown herein as a magazine 106. The playing card 102 includes a grid area 108 defined by a plurality of rows 110 and columns 112 delineating therein a grid of squares 114, each square including therein an indicia 116 as playing cards 2, 30, 36 and 60. The magazine 106 includes interspersed there throughout a plurality of advertising coupons 118. The playing card 102 is best shown in FIG. 10 and is a card insert meaning that the playing card 102 can be inserted into the magazine 106 while the magazine 106 is being stitched or stapled together at a bindery.

The player of the game apparatus 100 will match indicia found in the playing card squares 114, the playing card indicia 116 being either a product name or cents-off value as the case may be, with indicia found on the magazine coupons 118 being product name indicia or cents-off indicia. The coupons 118 are interspersed throughout the magazine 106 with pages of unrelated printed material therebetween. The player attempts to produce a predetermined orientation or pattern of matched indicia to produce a win.

As in the fourth embodiment of the present game apparatus, the set of playing cards 102 can include portions or groups thereof with each portion or group of the playing cards including a different orientation or pattern of indicia 116 in the squares thereon. Further, the number of playing cards provided in each portion or group can be different. In doing so, the various players, each of which are playing with a playing card 102 having a different orientation, will have to produce a different orientation or pattern of matched indicia to produce a win. In such a case, there can be provided different prizes for producing the different matched orientations with a more valuable prize being awarded to a person who produces a match associated with that portion or group of the playing card set having the fewest number.

Figure 11:
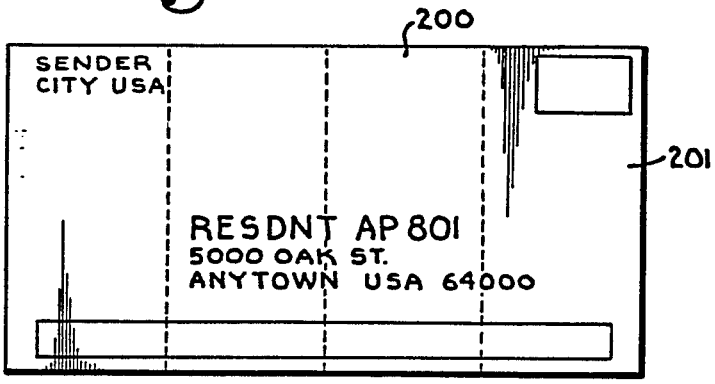
FIG. 11 is a front elevational view of a sixth embodiment of the present invention showing a free-standing postal card.
Figure 12:
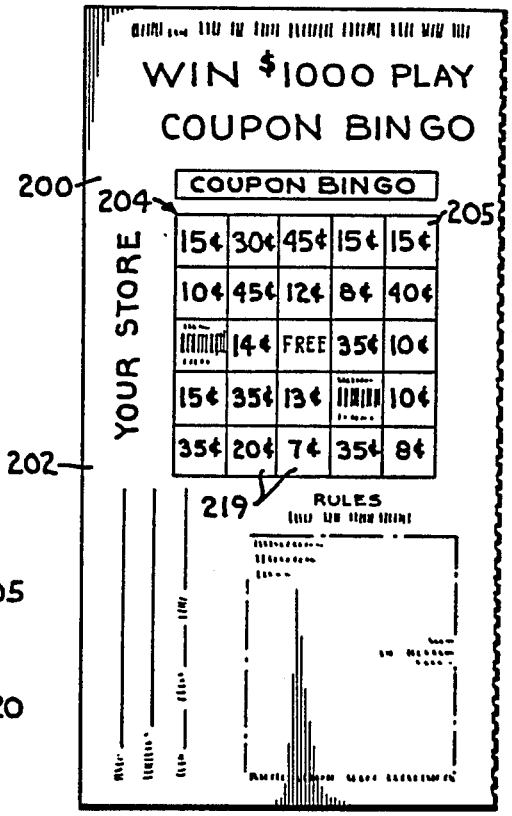
FIG. 12 is an enlarged, fragmentary rear elevational view of the postal card showing a playing card similar to the playing cards shown in FIGS. 2, 3, 4, and 9.

A sixth embodiment of the present invention is shown in FIGS. 11 through 14. FIG. 11 shows a postal card 200, which may be used in conjunction with a free-standing insert to effect a direct mail advertising project. Direct mail advertising is well known and is used to provide direct advertising access to millions of residences, without the requirement that the resident purchase a paper, magazine or the like to receive the advertising. In one form, a free-standing insert or publication, such as insert 50 discussed above, is mailed together with a required postal card 200 to selected postal addresses. The postal card 200 is necessary to indicate that postage has been paid, and to alert the resident that a mail advertisement publication is to be delivered. It is noted that although the direct mail advertising publication is referred to as a free-standing insert, it is not actually inserted into another publication, but the material is the same type as the free-standing insert 50 which is commonly provided with a newspaper or other publication.

The postal card 200 has a front side 201, upon which is printed a mailing address and a return address. A back side 202 of the postal card 200 typically has advertising material printed thereon; however, as illustrated, at least a portion of the card back side 202 has a playing card 204 printed thereon, which card 204 is substantially similar to the playing cards 2, 30, 60 and 102, and includes a body or matrix 205, which is divided into vertical columns and horizontal rows as previously described. The rows and columns form squares 219 which contain certain area indicia 220.

Figure 14:
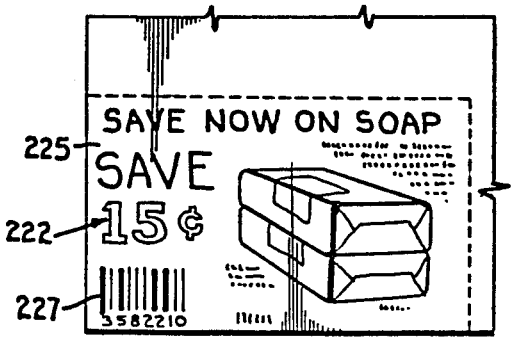
FIG. 14 is a plan view of a product coupon having a Universal Product Code symbol thereon.

The free-standing publication, which accompanies the postal card 200, contains a plurality of advertising coupons such as coupon 225 shown in FIG. 14. The game is played as previously described wherein a player matches a suitable coupon indicia 222 with an area indicia 220 to produce a predetermined orientation or pattern of matched indicia to produce a win.

As with the previous embodiments, the provision of the present invention with a direct mail advertisement also provides a self-contained bingo-type game which encourages players to scan the advertisement in search of the win-producing coupon indicia 222.

As in the other embodiments, control can be excercised over the playing cards 202 such that different portions or groups of cards can be provided with otherwise identical direct mail advertisements. In this manner, a first group of playing cards can have a winning pattern associated with a particular prize, such as a grand prize, while a second group can be printed with a second predetermined pattern associated with a different prize, or no prize.

Also, the paper having the playing card 204 printed thereon need not be the postal card 200 accompanying the free-standing insert, but rather may be a separate card that is simply inserted into the free-standing publication prior to mail delivery. As indicated in phantom lines in FIG. 11, the card 200 may be divided into different advertising areas, such that the present playing card 204 is printed on one area, while the other areas have different advertisements. The provision of the playing card 204 on a separate card which is provided with the free-standing insert (but not on the postal card itself) allows the present invention to be played on a local or regional level. Because the direct mail advertisement campaigns are typically run on a nationwide level, with publication numbers in the tens of millions, it may be more practicable for a group of advertisers to conduct the game on a local or regional level. Typically, the back side 202 of the postal card 200 is sold on a nationwide scale, thus eliminating the back side 202 as a possible vehicle for a local or regional game.

It is also envisioned that the game as previously described could be played, as a self-contained game, with the playing card 204 printed on a page of the free-standing insert itself.

Figure 13:
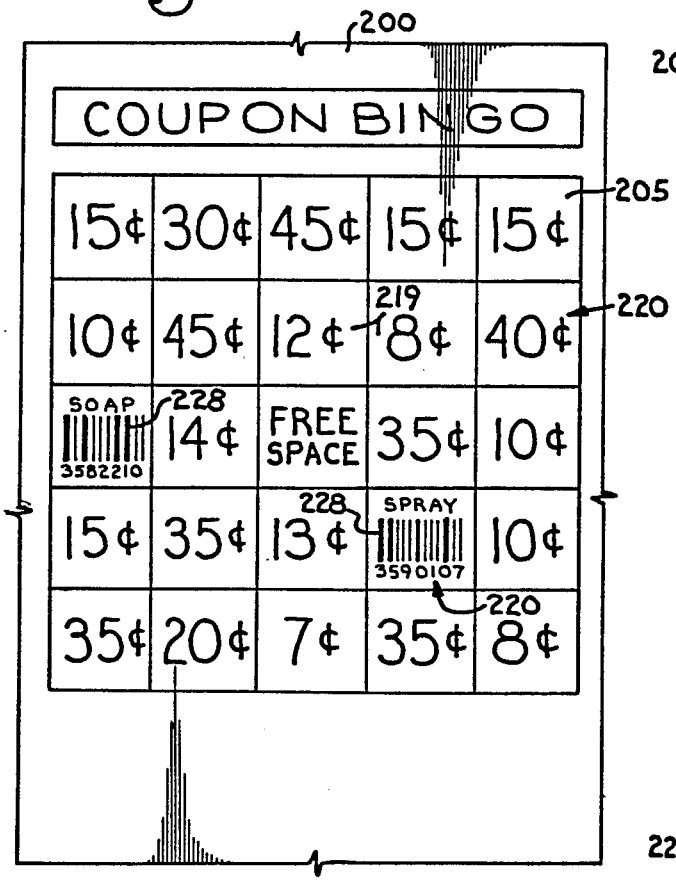
FIG. 13 is a detailed view of the playing card of FIG. 12 showing Universal Product Code symbols as playing card indicia.

FIGS. 13 and 14 illustrate the use of a Universal Product Code (UPC) symbol 227 as area indicia 220 and coupon indicia 222. The UPC symbol is a bar code that has been adopted by the food industry and comprises a series of vertical bars which reflect light emitted by an optical scanner in the grocery store. It is well known to use the UPC symbol in computerized inventory control and pricing systems. The optical scanner reads the UPC code and relays it to a central computer which records inventory data and alerts the cashier's terminal as to the price for the product. Advertisers use the UPC code symbol in their advertising coupons 225, as an aid to the grocery stores, for reasons not related to the present invention. The present game can be conducted such that the UPC symbol 227 may be used as coupon inidicia to be matched with area indicia on the playing card 204. As seen in FIG. 13, a square 219 is printed with UPC indicia 228, which can be matched with the UPC symbol 227 the same way as value indicia and product indicia are used.

It is to be understood that while certain embodiments of the present invention have been illustrated and described, it is not to be limited to the specific forms or arrangement of parts described and shown herein, except insofar as such limitations are included in the following claims.

What is claimed and desired to be secured by Letters Patent is:

1. A game for players of the type known as "bingo" comprising:

(a) a set of free-standing inserts, each of said free-standing inserts comprising a plurality of pages, each of said free-standing inserts being presented in combination with a respective run of press publication;

(b) each of said free-standing inserts including a playing card printed on a page thereof having a grid thereon defined by several rows and columns forming a set of patterned areas, each patterned area respectively bearing an individual area indicia;

(c) each of said free-standing inserts including a plurality of coupons common to all players printed thereon, and for each insert at least a portion of said coupons being positioned at various locations therein so as to be spaced from one another and from said playing card; for each insert at least a portion of said coupons being located on pages separate from said playing card; each coupon respectively bearing individual coupon indicia comprising together a coupon indicia set; each player having an identical set of coupon indicia bearing coupons; and (d) said area indicia and said coupon indicia of each insert being cooperatively related, in that selected coupon indicia from said coupon indicia set are matched area indicia with selected indicia from the area indicia set such that said matched area indicia describe at least a complete row or column or diagonal on said playing card grid, whereby each player is urged to scan said free-standing insert to determine the presence of said coupons in order to produce said predetermined pattern of matched area indicia.

2. The game as set forth in claim 1 wherein:

(a) said set of free-standing inserts comprises a first group and a second group; each playing card in said free-standing insert set first group has said area indicia arranged in an identical first pattern; each playing card in said free-standing insert set second group has said area indicia arranged in an identical second pattern; and said first pattern is not identical to said second pattern; and (b) said playing cards with said set of free-standing inserts in said first group are capable of producing a first predetermined matched indicia pattern; said playing cards with said set of free-standing inserts in said second group are capable of producing a second matched indicia pattern; and said first and second matched indicia patterns are dissimilar.

3. The game as set forth in claim 1 wherein:

(a) said coupons are "cents-off" product promotional coupons.

4. The game as set forth in claim 1 wherein:

(a) said areas are squares.

5. The game as set forth in claim 1 wherein:

(a) said indicia are monetary values.

6. The game as set forth in claim 1 wherein:

(a) said indicia are product identities.

7. The game as set forth in claim 1 wherein:

(a) said indicia are manufacturer's names.

8. The game as set forth in claim 1 wherein:

(a) said area indicia and said coupon indicia are identities of products which are advertised in said free-standing insert.

9. The game as set forth in claim 1 wherein:

(a) said area indicia and said coupon indicia comprise a combination of "cents-off" coupon values and identities of certain products which are advertised in said free-standing insert.

10. The game as set forth in claim 1 wherein:

(a) at least one area on said grid is designated as a free area such that it does not contain therein an area indicia for matching with a certain coupon indicia.

11. The game as set forth in claim 1 wherein:

(a) said area indicia and coupon indicia comprise universal product code symbols.

12. A game for players of the type known as "bingo" comprising:

(a) a set of free-standing advertising publications comprising a plurality of pages;

(b) a set of playing cards, one of said set provided with each copy of said publication; each of said cards having a playing matrix divided into several columns and rows forming a plurality of playing squares with individual area indicia contained therein;

(c) each of said free-standing publications including a plurality of coupons common to all players printed therein; at least a portion of said coupons being positioned at various isolated locations throughout said publication; each coupon bearing individual coupon indicia;

(d) said area indicia and said coupon indicia being cooperatively related, in that selected indicia from the coupon indicia set are matched area indicia with selected indicia from the area indicia set such that said matched area indicia describe at least a complete row or column or diagonal on said playing card grid; whereby each player is urged to scan the pages of said publication to determine the presence of said coupons in order to produce said predetermined pattern of matched area indicia.

13. The game as set forth in claim 12 wherein:

(a) said publication is a direct mail advertising publication that is adapted to be mailed to the player with one of said playing cards.

14. The game as set forth in claim 13 wherein:

(a) said playing card is printed on a postal card accompanying said direct mail advertising publication.

15. The game as set forth in claim 13 wherein:

(a) said playing card is printed on a page of said direct mail advertising publication.

16. The game as set forth in claim 13 wherein:

(a) said playing card is printed on a separate card adapted to be presented with said direct mail advertising publication.

* * * * *